United States Patent [19]

Smith

[11] Patent Number: 4,470,361

[45] Date of Patent: Sep. 11, 1984

[54] RAILWAY SEWING SYSTEM

[76] Inventor: Donald L. Smith, Rte. 12, Sleepy Hollow Dr., Greenville, S.C. 20609

[21] Appl. No.: 353,892

[22] Filed: Mar. 2, 1982

[51] Int. Cl.[3] ..... D05B 3/00

[52] U.S. Cl. ..... 112/121.14; 112/315

[58] Field of Search ..... 112/121.14, 121.11, 112/314, 315

[56] References Cited

U.S. PATENT DOCUMENTS

| | | | |
|---|---|---|---|
| 2,593,196 | 4/1952 | Rotherham | 112/121.14 |
| 2,724,352 | 11/1955 | Gentry et al. | 112/121.14 |
| 2,836,133 | 5/1958 | Gamble et al. | 112/121.14 |
| 2,836,135 | 5/1958 | Briggs | 112/315 |
| 3,396,686 | 8/1968 | Davidson et al. | 112/121.14 |
| 3,750,603 | 8/1973 | Martin | 112/121.11 |
| 4,242,974 | 1/1981 | Beckerman | 112/315 |

*Primary Examiner*—Ronald Feldbaum
*Attorney, Agent, or Firm*—Dority & Flint

[57] ABSTRACT

Railway sewing apparatus is disclosed for sewing and piecing together the free ends of two separate sheets of fabric which includes a frame 10 on which a horizontally extending rail A is carried. A sewing unit B is carried for horizontal movement back and forth across the rail and a sewing machine 50 is carried by the sewing unit. A D.C. drive motor 76 and rack and pinion gear drive 18, 82 impart a drive motion for driving the sewing unit B across rail A when energized. Means for driving the sewing machine 50 at a constant sewing speed is provided by a separate A.C. motor 44. An electrical control circuit 100 provides a variable output responsive to the position of the sewing unit on the rail energizing the drive motor as sensed by cams 36, 38 and switches 92, 94. The drive control has a first output at 128 energizing the drive motor means at a first, low drive speed over a first portion of the rail and a second output at 128 energizing the drive motor at a second, high drive speed over a second portion of the rail. Thus, a greater number of stitches per inch is sewn in the fabric positioned over the first portion of the rail than the number of stitches in the fabric positioned over the second portion of the rail.

13 Claims, 10 Drawing Figures

RAILWAY SEWING SYSTEM

BACKGROUND OF THE INVENTION

The invention relates to a railway sewing system for sewing and piecing together of two free ends of separate sheets of fabric across the full width thereof joining same as one piece for subsequent processing in a textile plant. More particularly, the invention relates to stitch multiplier apparatus for adjustably and automatically multiplying the number of stitches at the selvedges of the fabric for additional strength where the forces on the joint tend to be concentrated.

Heretofore, arrangements have been utilized which include a horizontal extending fabric support along which a sewing head employing a sewing machine moves to stitch ends of the two fabric sheets together. Typically, the drive for the traversing movement of the head and the drive for the sewing machine itself are transmitted by a single A.C. type drive motor. Since it is desired to drive the sewing machine at a constant rate, the output of the drive motor is controlled to produce a separate constant drive for sewing and a variable speed for the traversing head drive. The drive motion taken off of the shaft of the drive motor for the traversing sewing head is normally transmitted by sprocket and chain drives which are stepped down by means of a final worm gear drive along which the sewing head moves. However, in order to slow down the travel speed of the sewing head in the region of the selvedges to multiply the stitches, complicated clutch systems have been utilized having a large number of mechanical parts which influence reliability and requires considerable maintenance. Electromagnetic clutches have been employed which are controlled by feeler switches which sense the presence of the sewing head in the selvedge region and shift the chain drive to a slower transmission speed. Moreover, the environment of such mechanical arrangements and their required lubrication is not entirely compatible nor satisfactory for the sewing of fabric which easily can be soiled.

Accordingly, an important object of the present invention is to provide apparatus for sewing the ends of two separate fabric sheets together and automatically multiplying the number of stitches in the selvedge region of the fabric which is greatly simplified in its control and construction affording increased reliability.

Another important object of the present invention is to provide apparatus for sewing the ends of the two separate fabric sheets together which has fewer mechanical parts and presents a cleaner work environment for the sewing and processing of textile fabric.

Specifically, the object of the present invention is to provide railway sewing apparatus having a simplified drive transmission for the traversing sewing unit and control of the rate of speed of the sewing unit to multiply the stitch rate at the selvedge which is achieved by reliable electronic control of the input to the drive motor which may be varied electronically.

SUMMARY OF THE INVENTION

The above objectives are accomplished according to the present invention by providing a railway sewing system having a horizontal rail and fabric support carried on an upstanding frame and traversing sewing unit wherein a separate D.C. motor is employed to drive the sewing unit. A simplified rack and pinion drive transmission which can be easily disengaged by mounting the D.C. motor to a pivotal bracket which can be raised manually to pivot a pinion gear out of engagement with a rack carried on the rail to provide for manual movement of the sewing unit. The horizontal rate of speed of the sewing unit on the rail is controlled by controlling the input to the D.C. motor rather than the output making use of the highly simplified and reliable drive transmission possible. Constant rate of sewing speed is still achieved by employing a second motor to drive the sewing machine. An electronic control circuit controls the input to the D.C. drive motor in response to sensor signals indicating the position of the sewing head on the rail to multiply the stitches at the selvedges.

DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
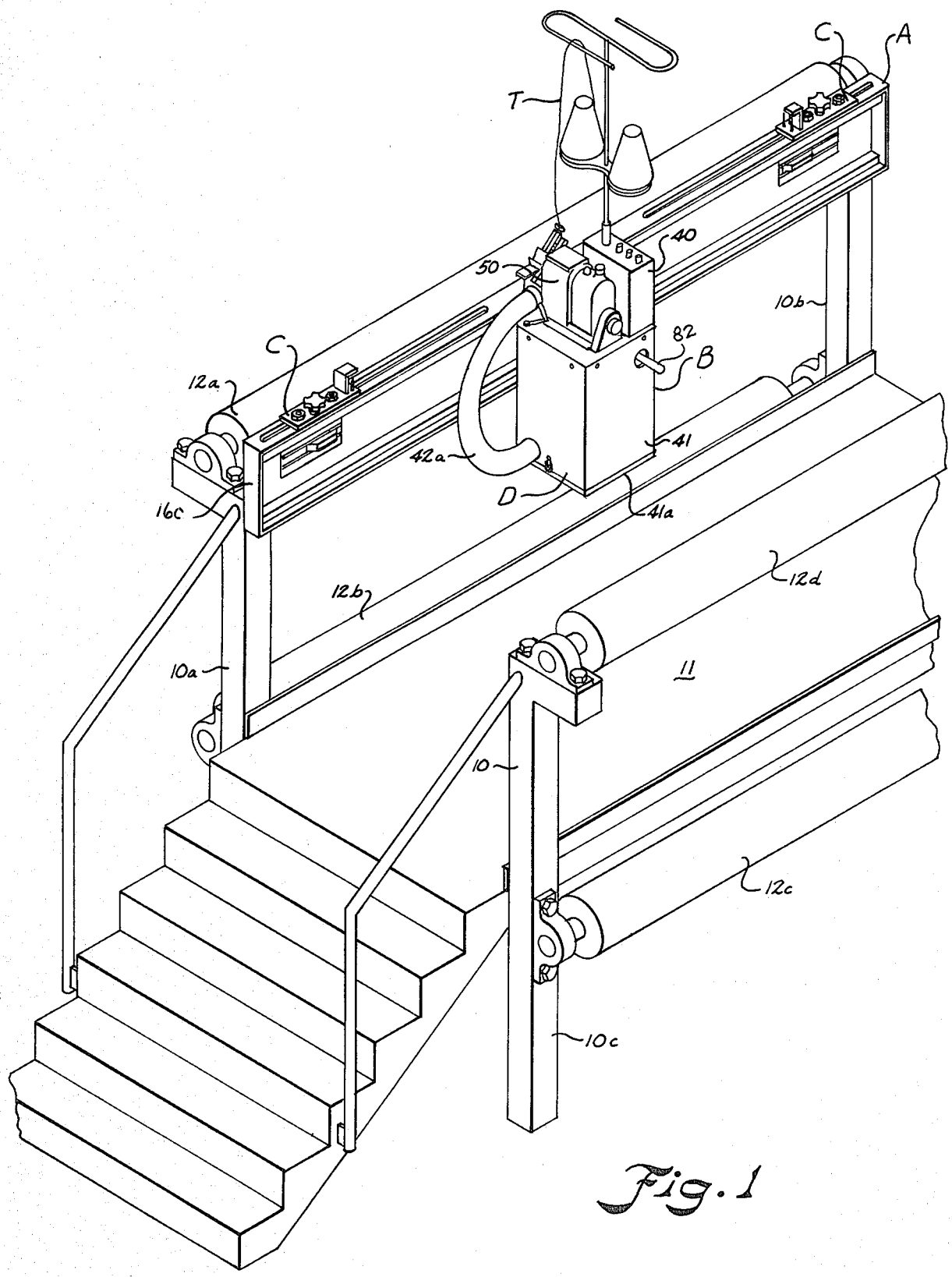
FIG. 1 is a perspective view of a railway sewing system according to the invention as carried on an inspection platform frame.
Figure 2:
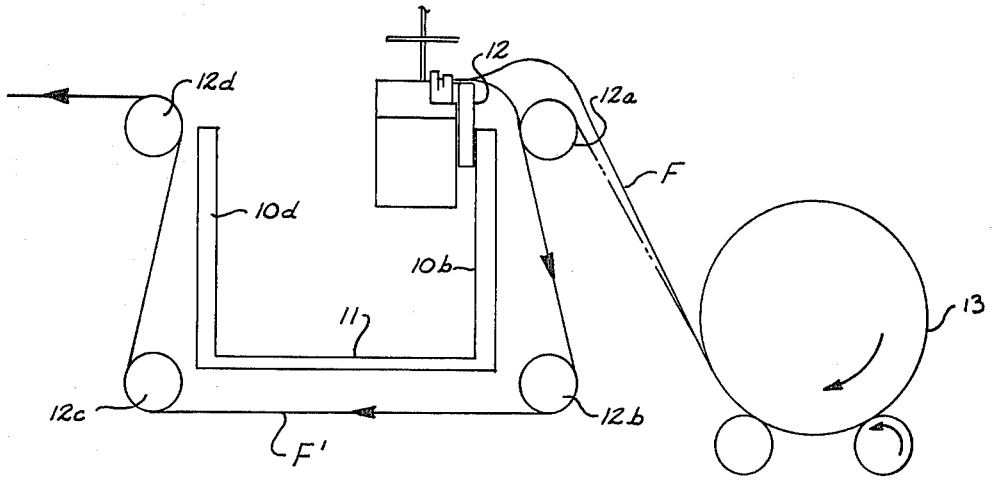
FIG. 2 is a schematic elevation illustrating the piecing and sewing together of the ends of two separate fabric sheets in accordance with the invention.
Figure 3:
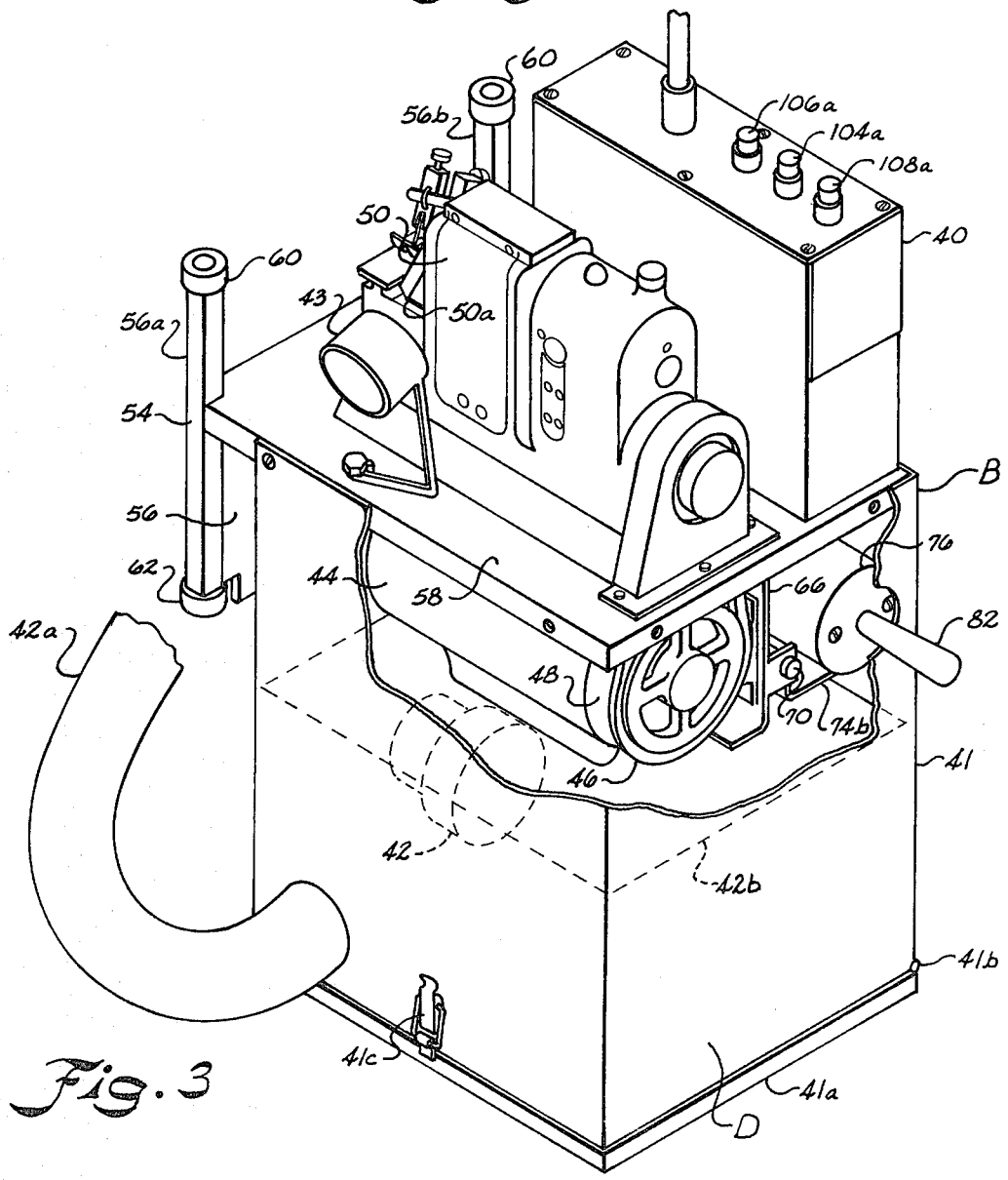
FIG. 3 is a perspective view with a part of the housing cut away illustrating a sewing unit constructed according to the present invention.

The invention relates to apparatus for sewing and piecing the ends of two separate sheets of fabric together during a piecing operation for further processing in a textile plant. A frame 10 is illustrated in the form of an inspection frame having an inspection platform 11 from which an operator may inspect the piecing operation and fabric. Upstanding frame legs 10*a*, 10*b*, 10*c*, and 10*d* support the frame and a plurality of rollers 12*a*–12*d* which are rotatably mounted by suitable bearing blocks attached to the frame. As can best be seen in FIG. 2, the fabric sheets being joined follow a path about the rollers in the direction illustrated by arrows. An end of a sheet of fabric F fed from a roll 13 is pieced with an end of a sheet of fabric F' to make a single continuous sheet. It is to be understood that other frame arrangements may be utilized with the railway sewing apparatus of the present invention such as a portable frame carried on casters.

Referring now in more detail to the drawings, a railway A is supported between standards 10*a* and 10*b* in a horizontally extending manner on which a sewing unit B is carried for horizontal movement back and forth across the railway. Railway A includes a horizontally extending rail, designated generally as 14, in the form of a channel box 16 having mounted on a lower flange 16*a* a rack gear 18 having teeth 20 facing upwards. Carried affixed to the upper flange 16*b* of the frame box is a downwardly projecting flange 22, the purpose of which will be described in more detail later.

A pair of cam assemblies C are carried on the top flange 16*b* by means of a slot 24 formed in the top flange through which threaded attachment studs 26 extend which attach a top plate 28 of the cam assembly to a bottom plate 30. The bottom plate 30 includes a vertical leg 30*a* and a horizontal leg 30*b* on which the threaded posts 26 are carried as extending through the slot 24 and thereafter are attached to the upper plate 28 by means of nuts 32. One of the threaded studs 26*a* is provided adjacent the upper plate 28 with a knob 34 which may be tightened against the plate 28 to bring the plates 30 and 28 tightly together to lock the cam assembly in a horizontal position in slot 24. The knob may likewise be loosened so that the cam assembly may slide along the length of the groove 24. In operation, the cam assemblies are set within the grooves 24 at each end of the rail A at the edge of the fabric sheets. Pins 35 are provided for holding the selvedges of the two sheets of fabric being sewn.

Figure 7:
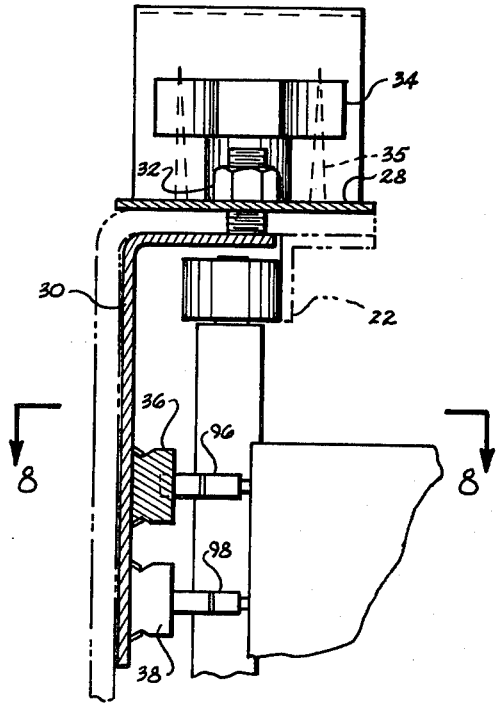
FIG. 7 is a sectional view taken along lines 7—7 of FIG. 5.
Figure 8:
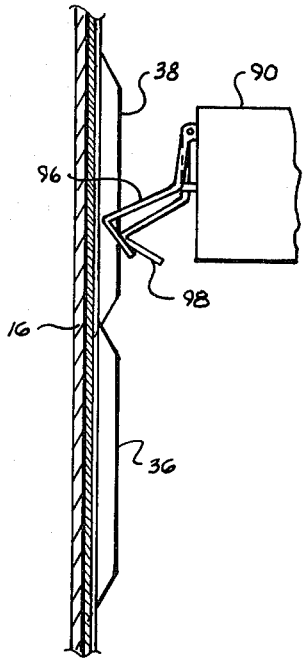
FIG. 8 is a sectional view taken along line 8—8 of FIG. 7.
Figure 9:
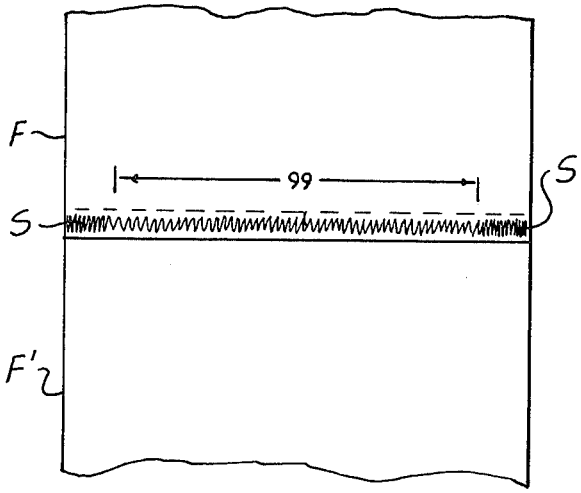
FIG. 9 is a plan view illustrating a fabric joined together by means of the railway sewing apparatus of the present invention illustrating the multiplication of the stitches in the region of the selvedge.
Figure 10:
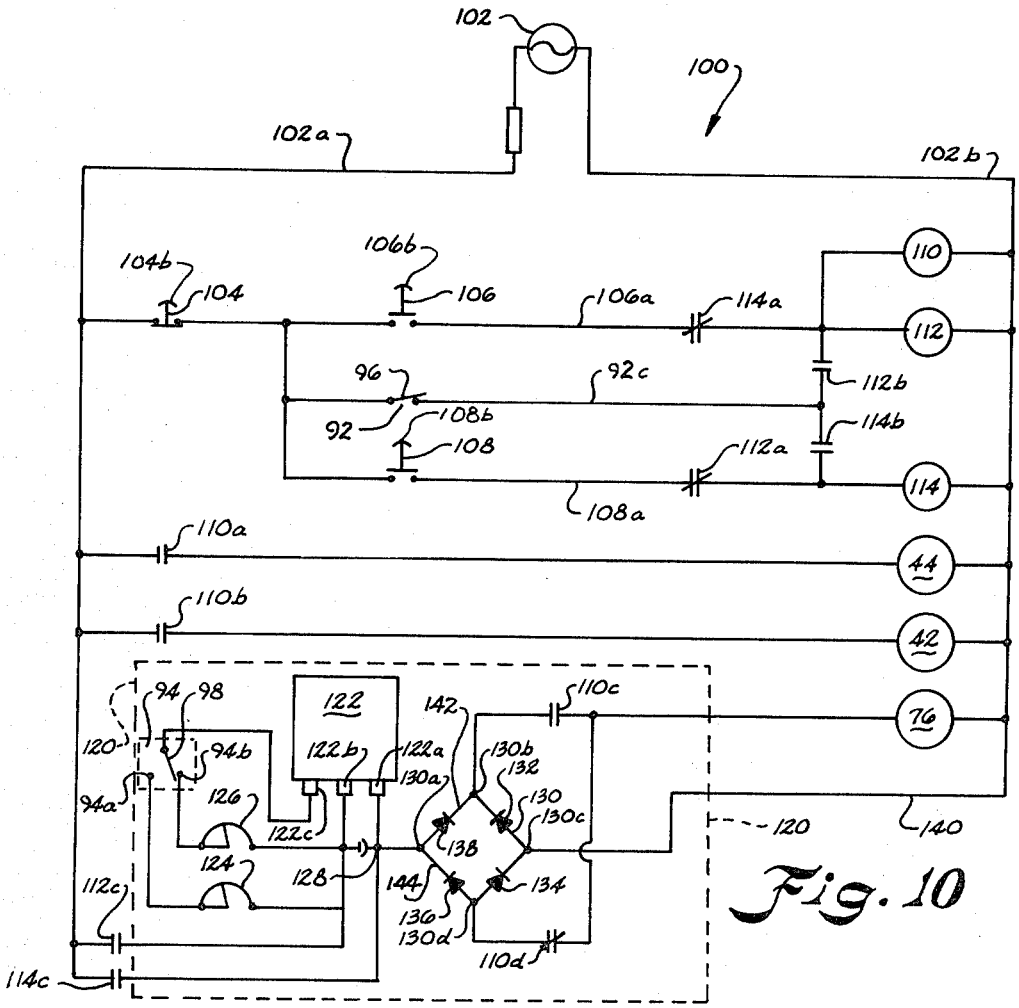
FIG. 10 is a schematic diagram of an electronic control circuit constructed according to the invention for controlling the horizontal rate of speed of a traversing sewing unit to multiply the stitches in the region of the selvedges according to the invention.

Each cam assembly C includes cam means in the form of a pair of cams 36 and 38. Cam 36 of each assembly is carried at the outermost limit of travel of the sewing unit B and serves to limit the travel as will be more fully explained. Cam 38 is set to correspond to that portion of the selvedge which is desired to be multi-stitched. Both control cams are retained in flanged grooves 37 and may be adjustably positioned therein and fixed by means of set screws 39. For this reason, the cams are shaped, as can best be seen in FIG. 7, to have an indented portion which is engaged and retained in the flanged groove 37. Each cam has a ramp surface, 36*a* and 38*a*, and a main camming surface, 36*b* and 38*b*.

Sewing unit B is illustrated as including a control box 40, a sewing machine 50 and a housing 41 which covers the drive unit which will be described later. The housing 41 also provides a housing for a vacuum unit D which vacuums the cuttings from the sewing machine unit as the sewing unit traverses the ends of the fabrics being sewed together. Any suitable sewing machine unit may be utilized at 50 such as that manufactured by the Merrow Machine Co. of Hartford, Conn., Model No. 70-D3B2 which is depicted in the drawing. This machine includes a cutter (not shown) which cuts the sewn fabric ends straight across as they are sewn, and it is this waste removed by the vacuum unit D.

Vacuum unit D includes a vacuum motor 42 and a vaccum hose 42*a* communicating with a vacuum chamber formed by and below a partition 42*b* and terminating at a ring support 43 on which the end of hose 42*a* is fitted. Support 43 is arranged so that the waste cuttings falling from chute 50*a* are carried away through the vacuum hose. The bottom 41*a* of housing 41 is hinged at 41*b* for emptying of the vacuum chamber. For this purpose, lock 41*c* is provided.

Figure 4:
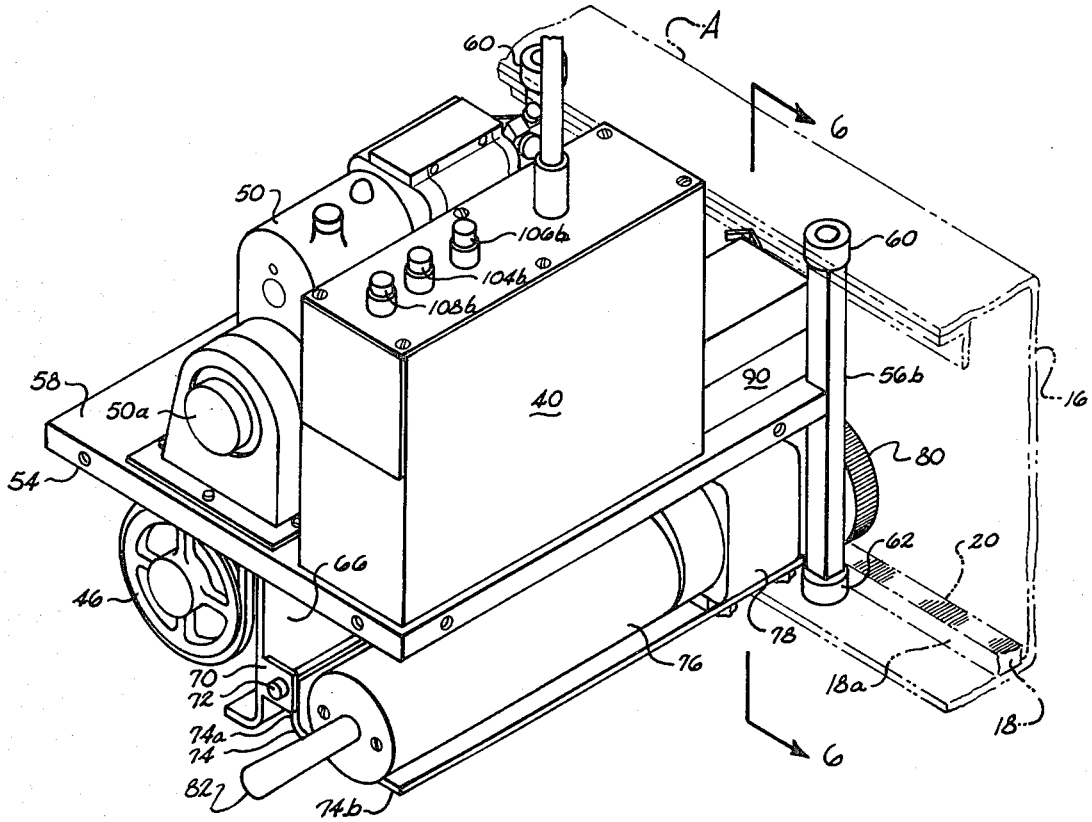
FIG. 4 is a perspective view with the housing removed of a sewing unit and drive arrangement constructed according to the present invention.
Figure 6:
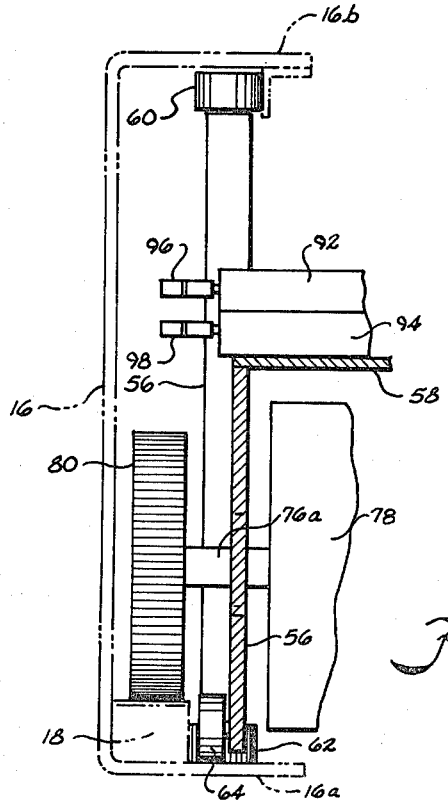
FIG. 6 is a sectional view taken along lines 6—6 of FIG. 4.
Figure 5:
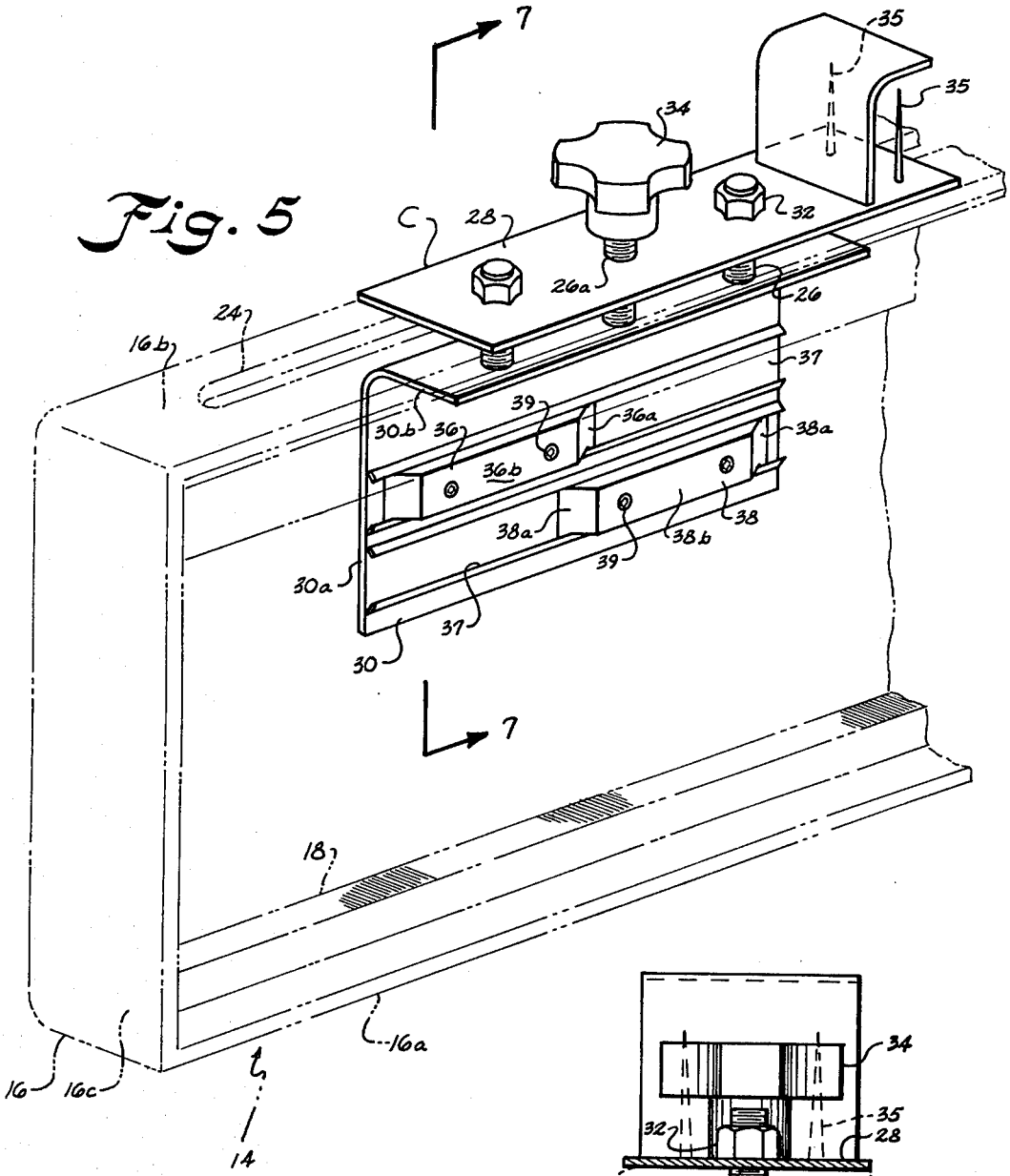
FIG. 5 is a perspective view illustrating an adjustable cam assembly constructed according to the present invention for actuating a limit switch limiting the movement of travel of a traversing sewing head and a speed control switch for switching the traversing head to a slower speed in the region of the selvedge for multiplying the stitches.

The drive unit for the sewing system includes a sewing machine drive motor 44 having a pulley 46 which through belt 48 drives a pulley (not shown) carried on the sewing machine drive shaft 50*a* to drive the sewing machine. Motor 44 is preferably an A.C. type electric motor providing a constant speed for the sewing machine 50. A carriage 54 carries the sewing unit B and includes a vertical frame plate 56 and a horizontal frame plate 58. The vertical frame plate carries upper rollers 60 and lower rollers 62 on upstanding legs 56*a* and 56*b*. Rollers 60 engage against the back side of top flange 22 and rollers 62 bear against the side 18*a* of gear rack 18, as can best be seen in FIGS. 4 and 6, as the sewing unit traverses the rail A. In addition, a pair of front vertical rollers 64 are carried by the frame plate 56 and roll on the top of the bottom flange 16*a*.

A vertical web 66 extends down from the bottom of the horizontal frame plate 58. The drive motor 44 is attached to the vertical web 66 by any suitable means such as bolts (not shown). A pivot support 70 is rigidly attached to the vertical web 66 and carries a pivot pin 72 about which an L-shaped bracket 74 pivots. A vertical leg 74*a* of the bracket has affixed thereto the pivot pin 72 which fits at its ends in the pivot opening carried by the pivot support 70 and retained therein by any suitable means. Horizontal leg 74*b* provides a mount for carriage drive motor 76. Means for driving the sewing unit across the railway A includes the drive motor 76 which includes a gear reduction box 78 having a pinion gear 80 carried on output shaft 76*a* thereof which meshes with the teeth 20 of the gear rack 18. By this means, the drive motion of motor 76 is transmitted for moving the sewing unit B. Drive motor 76 is a D.C. motor such as that manufactured by the Dayton Co. of Dayton, Ohio, as gearmotor model no. 42128 which is a complete gear/motor unit. The opposite end of the motor 76 includes a horizontally extending handle 82 affixed thereto by which the motor may be raised in a short arc to lift the gear 80 and disengage it from the gear rack 18. This is accomplished by means of the pivotable bracket 74 which pivots about the pivot support 70 during this motion. With handle 82 raised, gear 82 disengages permitting manual movement of unit B along the railway A.

The control unit 40 includes a switch box unit 90 which carries a pair of electrical switches 92 and 94. Each switch carries a zig-zag shaped switching lever 96 and 98, respectively. In operation, switch 96 is actuated by upper cam 36 of the cam assembly and switch lever 98 by the lower cam 98 of cam assembly C. Each switch lever includes a first inclined arm 96*a*, 98*a* terminating in a second arm 96*b*, 98*b* bent away from the first arm. So shaped, the switches are reliably actuated by main camming surfaces 36*b*, 38*b*, respectively, as they glide up the camming ramp surfaces 36*a*, 38*a* moving in either direction across the cams 36, 38.

Electrical control means having a variable output responsive to the position of sewing unit B on railway A is provided for energizing carriage drive motor 76 accordingly. The control means includes sensor means in the form of electrical switches 92, 94 which generate a signal indicating the position of the sewing unit B as actuated by cams 36 and 38, respectively. As previously mentioned, with cam assemblies C set at the fabric selvedges, switch 92 serves as a limit switch and generates a signal terminating the drive of the sewing unit at the outermost horizontal limits between which the unit may be driven. Switch 94 provides an intermediate switch between the limit positions and generates a signal responsive to the sewing unit being present in a first portion of the railway corresponding to that region S of the selvedge in which it is desired to multiply the stitches by slowing down the rate of travel of the sewing unit. After switch 94 comes off cam 38, the control means returns the sewing unit to its normal rate of speed in the region 99 until the left cam 38 is reached whereupon switch 94 is again actuated and the unit B is again slowed at the other selvedge S. This description assumes sewing unit travels from right to left.

The electrical control means further includes an electrical control circuit 100 for processing the signals from switches 92, 94 and controlling energization of drive motor 76 accordingly.

While many circuits may be utilized to control the speed of motor 76, the below described circuit has been found to be particularly advantageous as a simplified, reliable means of electrical control which may be adjusted electronically to vary the motor speed and hence the stitch rate.

As illustrated, circuit 100 includes an A.C. power source 102 connected to the circtui via wire lead **102*a* and 102*b*. Connected across the leads is a normally closed stop switch 104, and three parallel switches 106, 92, and 108, and switch circuits 106*a*, 92*c*, and 108*a* in series with switch 104. Switch 106 is the sewing switch and is normally open, switch 92 is the limit switch which is normally closed but opened when switch lever 96 is on the cam 36, and switch 108 is the return switch for return of the sewing unit B to its start position and is normally open. Solenoids 110, 112, and 114 are connected to the switching circuits. A normally closed solenoid contact 114*a* connects switch 106 to the solenoids. Switch 108 is connected by way of a normally closed contact 112*a* to solenoid 114 and by normally open contacts 114*b* and 112*b* to solenoids 110 and 112. Switch 96 is connected by contact 112*b* to solenoids 110 and 112 and to solenoid 114 by contact 114*b***.

Sewing machine motor 44 is connected across leads **102*a* and 102*b* via normally open contacts 110*a* of solenoid 110. Vacuum motor 42 is connected across the leads via normally open contacts 110*b* of solenoid 110**.

Sewing unit drive motor 76 is connected across leads **102*a* and 102*b* by means of variable speed control circuit 120 by which the energization and drive speed of the motor may be varied to vary the stitch rate and multiply the stitches in a selected region of the selvedges as determined by the placement of cam 38 and corresponding actuation of two-way switch 94**.

Speed control circuit 120 includes a speed control triac 122 having a first terminal **122*a* connected to normally opened contacts 114*c* which in turn are connected to lead 102*a*, and a terminal 122*b* connected to lead 102*a* via normally open contacts 112*c* of solenoid 112. A third terminal 122*c* of the speed control triac is connected to an adjustable biasing circuit which includes a first variable pontentiometer 124 connected to a first terminal 94*a* of speed control switch 94 and a second variable potentiometer 126 connected to a second terminal 94*b* of switch 94. The other side of the potentiometer is connected to terminal 122*b* and output terminal 128 of the speed control triac. By manually adjusting the two potentiometers, the biasing voltage on the speed control triac is varied producing two different speed control signals at 128 for driving D.C. motor 76 depending on the position of speed control switch lever 98** and the setting of the adjustable potentiometer.

Circuit 122 may be any suitable A.C. phase control circuit such as that manufactured by Omnetics, Inc. of Syracuse, N. Y., model no. 1502A.

The position of switch lever 98 depends on the location of the sewing unit B along railway A. With actuating cam 38 set in place at the fabric selvedges, the lever 98 contacts switch contact **94*a* when on the surface 38*b* of cam 38 to slow the speed of the sewing unit and multiply the stitches. Coming off of the cam, lever 98 contacts 94*b* to energize motor 76 at a normal and faster rate of speed in the area 99** of the seam joint to produce a lower number of stitches per inch.

Output 128 is connected to a rectifier bridge circuit 130 having an input terminal **130*a* and terminals 130*b*, 130*c*, and 130*d* connected to the motor 76. Terminal 130*b* is connected to the motor through normally open contacts 110*c* of solenoid 110 and terminal 130*d* is connected through normally closed contacts 110 to the motor. Terminal 130*c* is connected to the other side of motor 76 to provide a free-wheeling mode of operation through diode 132. The circuit includes other diodes 134, 136, and 138. Diodes 132 and 138 are connected cathode to cathode in a first branch 142 of the bridge circuit connected between terminals 130*a* and 130*c* with intermediate terminal 130*b* therebetween. Diodes 134 and 136 are connected anode to anode in a second branch 144 of the bridge between terminals 130*c* and 130*a* with intermediate terminal 130*d* connected to the drive motor. Relays 110*c* and 110*d*** provide contact switch means for selective energization of the drive motor in forward and reverse directions, respectively.

OPERATION

In order to initiate the sewing operation, first the sew button **106*b* is depressed closing switch 106 and the circuit. The current flows through the normally closed stop switch 104, the closed sew switch 106 through the normally closed contact 114*a* to energize the relays of solenoids 110 and 112. Upon energizing relay 112, relay contact 112*b* is closed allowing the current to flow from lead 102*a* through the stop switch, limit switch 96, now closed contact 112*b* interlocking the relays of solenoids 110 and 112**.

Contact **112*c* is also closed and current flows from lead 102*a* through one of the potentiometers 124 or 126 depending on the position of speed control switch 94 as actuated by cam 38. The sewing unit B will be to its right-most position on railway A when sewing is initiated and assuming limit switch 96 is off of cam 36, switch 94 will be on cam 38. Speed control switch contact 94*a* will be closed producing a first speed control signal at the output of speed control triac 122 at 128 which will energize the motor 76** to multiply the stitching at the right selvedge.

During operation, rectifier circuit 130 operates as a half-wave rectifier with the free-wheeling diode 132 in an over-run mode. The positive half of the A.C. signal at 128 is fed through diode 138, terminal **130*b*, through contact 110*c* to energize D.C. drive motor 76. In other words, on each positive cycle of the voltage, a positive signal is fed to the D.C. drive motor and on the negative half cycle of the signal, the momentum of the D.C. drive motor causes a voltage to be produced back through lead line 140 and free-wheeling diode 132**. This has been found to reduce cogging or hunting of the motor making it run more smoothly to drive the sewing unit more smoothly for sewing.

The D.C. drive motor 76, which is the traversing motor for the sewing machine, is maintained energized until limit switch 96 is opened by cam 36 on the frame of the machine near the end of the desired path of the sewing machine. However, prior to reaching the limit position, switch 94 will again be switched by the left cam 38 to multiply the stitches at the left selvedge. Upon striking cam 36, limit switch 96 is opened, deenergizing solenoid relays 110 and 112. Upon deenergization, the sewing machine motor 44, the vacuum motor 42, and the D.C. drive motor 76 are all deenergized. The operator then cuts the thread T that was being used for making the stitch and upon removing the thread, the return switch button **108*b* is depressed. The relay of solenoid 114 is then energized closing contact 114*b* interlocking the return switch 108 so as to only require a momentary depressing of the return button 108*b* or the return button has to be depressed for a sufficient period of time to allow the sewing machine to move off of the stop limit cam 36. Once the limit switch moves off the stop cam, the return button of switch 108 can be released and the relay 114** remain energized.

With the relays of solenoid 114 energized, contact **114*a* is closed, allowing the negative half of the cycle to flow through diode 136 forming part of the bridge circuit and through the normally closed contact 110*d* to the D.C. motor 76 causing the D.C. motor to be driven in a reverse, opposite direction causing sewing unit B to return to its initial right-most position. Upon reaching this position, limit switch 96 is again opened by cam 36 deenergizing the entire circuit rendering the system ready for another piecing operation. Diode 134 operates in the same manner as the diode 132**; that is, it is a free-wheeling diode which operates with the negative half of the A.C. signal.

Thus, it can be seen that a simplified yet reliable railway sewing system can be had according to the invention by which stitches at the selvedges of fabric being joined can be multiplied at a desired rate. By utilizing a separate motor for the traversing drive motion, and by controlling the input to the motor rather than its output to vary the traversing speed of the sewing unit, complicated mechanical drive arrangement are eliminated along with their attendant problems.

While a preferred embodiment of the invention has been described using specific terms, such description is for illustrative purposes only, and it is to be understood that changes and variations may be made without departing from the spirit or scope of the following claims.

What is claimed is:

1. Railway sewing apparatus for sewing and piecing together the free ends of two separate sheets of fabric comprising:

a frame;

a horizontally extending rail carried by said frame;

a sewing unit carried for horizontal movement back and forth across said rail;

a sewing machine carried by said sewing unit;

drive motor means imparting a drive motion for driving said sewing unit across said rail when energized;

sewing drive means for driving said sewing machine at a constant sewing speed;

electrical control means having a variable output responsive to the position of said sewing unit on said rail for energizing said drive motor means;

said control means having a first output energizing said drive motor means at a first drive speed over a first portion of said rail and a second output energizing said drive motor at a second drive speed over a second portion of said rail;

said apparatus sewing a greater number of stitches per inch in the fabric positioned over said first portion of said rail than the number of stitches in the fabric positioned over said second portion of said rail;

said drive motor means including a D.C. motor having an output shaft and transmission means connected to said output shaft transmitting said drive motion for moving said sewing unit;

said transmission means including a pinion gear carried by said output shaft and a horizontally extending rack gear carried by said rail which meshes with said pinion gear; and said drive motor means being included in said sewing unit and said sewing unit between movably carried on said frame, said movable sewing unit having a first position in which said pinion gear is engaged with said rack gear and said drive motion is transmitted, said movable sewing unit having a second position in which said pinion gear is moved away and disengaged from said rack gear so that said sewing unit may be manually moved on said rail.

2. The apparatus of claim 1 wherein said electrical control means includes sensor means generating an output signal indicating the position of said sewing unit on said rail.

3. The apparatus of claim 2 wherein said sensor means includes limit switch means generating a signal terminating the drive of said sewing unit at selected outermost limits between which said sewing unit is driven and speed control switch means intermediate said limit switch means generating a signal responsive to said sewing unit being present in said first portion of said rail.

4. The apparatus of claim 2 wherein said sensor means includes speed control switch means carried by said sewing unit and cam means carried at selected positions across said rail corresponding generally to said first portion for actuating said switch means.

5. The apparatus of claim 4 wherein said switch means includes a switch lever having a first inclined arm terminating in a second arm bent away from said first arm, said cam means including ramp camming surfaces against which said first and second arms engage in respective opposite directions of movement of said sewing unit.

6. The apparatus of claim 2 wherein said sensor means includes a pair of cam assemblies adjustably carried on said rail so as to be positioned at the selvedges of said fabric, each said cam assembly including a cam plate and cam means carried on said plate, said cam means being adjustable in position relative to said plate and said plate is adjustable in its position relative to said rail.

7. The apparatus of claim 3 wherein said sensor means includes a pair of spaced cam assemblies each having first and second cams carried on a cam plate positioned at the selvedges of said fabric, said first cam being displaced horizontally along said rail from said second cam for actuating said speed control switch means, said second cam being being positioned at the outermost limit of drive movement of said sewing unit for actuating said limit switch means, said position of said first cam corresponding to said first portion of said rail so that the stitches are multiplied in said fabric at said selvedges.

8. The apparatus of claim 2 wherein said sensor means produces a first output signal over said first said portion and a second output signal over a second rail portion and said electrical control means includes an electrical control circuit which comprises:

a speed control circuit connected to said sensor means receiving said output signal therefrom having adjustable biasing means;

said speed control circuit producing a first speed control signal in response to said first sensor output signal and a second speed control signal in reponse to said second sensor output signal, and means connecting said speed control circuit to said drive motor means.

9. The apparatus of claim 8 wherein said adjustable biasing means may be adjusted to vary said first an second speed control signals varying the number of stitches per inch over said first and second portions of said rail.

10. The apparatus of claim 8 including a bridge circuit connected to said speed control circuit which includes:

a first branch connected to an output terminal of said speed control circuit including a pair of diodes connected cathode to cathode;

a first terminal between said cathodes connected to said drive motor;

a second branch connected to said output terminal and said first branch including a pair of diodes connected anode to anode; and a second terminal connected between said anodes and connected to said drive motor.

11. The apparatus of claim 10 including contact switch means connected between said first terminal and said drive motor and between said second terminal and said drive motor selectively controlling forward and reverse energization of said drive motor.

12. The apparatus of claim 1 wherein said sewing unit is pivoted to said second position.

13. Railway sewing apparatus for sewing and piecing together the free ends of two separate sheets of fabric comprising:

a frame;

a horizontally extending rail carried by said frame;

a sewing unit carried for horizontal movement back and forth across said rail including a sewing machine;

drive motor means imparting a drive motion for driving said sewing unit across said rail when energized;

electrical control means responsive to the position of said sewing unit on said rail for energizing said drive motor means having a first output energizing said drive motor means at a low drive speed over a first portion of said rail and a second output energizing said drive motor at a higher drive speed over a second portion of said rail;

said electrical control means including an electrical control circuit which includes a speed control circuit having an adjustable biasing means;

said adjustable biasing means being adjustable to vary said first and second output signals varying the number of stitches per inch over said first and second portions of said rail;

a bridge circuit connected to said speed control circuit which includes a first branch connected to an output terminal of said speed control circuit including a pair of diodes connected cathode-to-cathode; a first terminal between said cathodes connected to said drive motor; a second branch connected to said output terminal and said first branch including a pair of diodes connected anode-to-anode; a second terminal connected between said anodes connected to said drive motor; and a contact switch means connected between said first terminal and said drive motor and between said second terminal and said drive motor selectively controlling forward and reverse energization of said drive motor so that said sewing unit traverses said horizontal rail in forward and reverse directions.

* * * * *